US007784651B2

(12) United States Patent
Batschied et al.

(10) Patent No.: US 7,784,651 B2
(45) Date of Patent: Aug. 31, 2010

(54) FOAM THROTTLE

(75) Inventors: Karl Batschied, Wilhelmsfeld (DE); Juergen Blaess, Hirschberg/Leutershausen (DE); Kurt Oberhofer, Wilhelmsfeld (DE)

(73) Assignee: Huber Packaging Group GmbH + Co. KG, Oehringen (DE)

( * ) Notice: Subject to any disclaimer, the term of this patent is extended or adjusted under 35 U.S.C. 154(b) by 900 days.

(21) Appl. No.: 10/567,007

(22) PCT Filed: Jul. 1, 2004

(86) PCT No.: PCT/DE2004/001385

§ 371 (c)(1),
(2), (4) Date: Oct. 12, 2006

(87) PCT Pub. No.: WO2005/014466

PCT Pub. Date: Feb. 17, 2005

(65) Prior Publication Data

US 2007/0068975 A1 Mar. 29, 2007

(30) Foreign Application Priority Data

Aug. 1, 2003 (DE) ..... 103 36 009

(51) Int. Cl.
*B65D 3/00* (2006.01)

(52) U.S. Cl. ..... 222/484; 251/127; 251/324; 137/170.1; 222/522; 222/523; 222/547; 222/564

(58) Field of Classification Search ..... 137/170.1; 251/127, 324; 222/484, 522–523, 547, 564
See application file for complete search history.

(56) References Cited

U.S. PATENT DOCUMENTS 6,742,682 B2 * 6/2004 Batschied et al. ..... 222/559

FOREIGN PATENT DOCUMENTS

| | | |
|---|---|---|
| DE | 298 21 780 U1 | 2/1999 |
| DE | 198 25 929 A1 | 6/1999 |
| DE | 198 02 291 A1 | 8/1999 |
| GB | 2 181 720 A | 4/1987 |

OTHER PUBLICATIONS

International Search Report.

* cited by examiner

*Primary Examiner*—Kevin P Shaver
*Assistant Examiner*—Andrew P Bainbridge
(74) *Attorney, Agent, or Firm*—Galgano & Associates PLLC; Thomas M. Galgano; Jessica G. Bower

(57) ABSTRACT

A tap for removing liquid from a container has a sleeve (10) made of plastic, in which a piston (12) is guided, and which sleeve has a passage opening (28) for the liquid. A hood that can be set onto the sleeve (10) in front of the passage opening (28), so that it covers the passage opening (28), serves as a foam throttle. The hood encloses a labyrinth channel (36), together with the sleeve, which channel is open at one end, towards the interior of the container, and ends in the passage opening (28) at the other end.

19 Claims, 5 Drawing Sheets

FOAM THROTTLE

The invention relates to a foam throttle for a tap for removing liquid from a container, having a sleeve made of plastic, in which a piston is guided, and which has a passage opening for the liquid, which the piston seals off tightly in a locking position, in which it is moved in, and releases in a removing position, in which it is moved out.

Such taps are known from DE 198 25 929 A1, WO 02/072 469 A1, and WO 02/090 239 A1. They are mainly used for removing liquids that have been filled into containers under pressure, and are carbonated, particularly beverages, from kegs, small kegs (party kegs), or cans. This particularly involves party kegs for beer.

Beer is traditionally tapped with $CO_2$, under excess pressure. This technique is widespread in the restaurant business. It has the advantage that the beer comes to the consumer essentially saturated with $CO_2$. This is unexcelled for freshness, high quality, and flavor of the beer.

Party kegs for beer were originally intended to pursue the concept of bringing the tapping technique with $CO_2$ into household use. There are tap fittings with $CO_2$ cartridges that have a tapping pipe that is introduced through a bunghole at the top cap of the party keg all the way to its base. $CO_2$ under excess pressure is fed into the head space of the keg, in order to drive the beer up through the tapping pipe and dispense it. In this connection, the quality of the beer can be impaired, since the $CO_2$ excess pressure is not regulated. If the pressure is too low, $CO_2$ will gas out of the beer, and the beer will go flat. If the pressure is too high, over-carbonation of the beer will occur, accompanied by a deterioration of the flavor. Many consumers also hesitate to handle $CO_2$ cartridges and to tap beer kegs with them, because they consider it to be complicated and expensive.

A party keg can be emptied without $CO_2$, under the effect of gravity, with simultaneous pressure equalization. For this purpose, a tap of the type stated initially, which is integrated into a party keg, was developed. The tap is used, together with a pressure equalization valve that is operated by hand, in a bunghole at the top cap of the keg. The consumer can ventilate the keg by way of the valve, and bring about emptying without pressure, simply by means of gravity.

A disadvantage in this connection is that the beer comes into contact with oxygen, and that $CO_2$ gases out of the beer. Remedy is seen in a $CO_2$ dispenser that is located in the interior of the party keg and gives off a regulated $CO_2$ excess pressure into the head space of the keg, when it is tapped for the first time. The $CO_2$ dispenser is activated by the user in the same manner as the pressure equalization valve at the cap of the keg is presently activated. The $CO_2$ excess pressure guarantees that the $CO_2$ that is present in the beer remains in solution and no oxygen gets into the head space of the keg.

For the CO2 excess pressure in the head space of the keg, a value of approximately 0.6 to 0.8 bar is aimed at. As compared with the current state of emptying the keg solely by means of gravity, with pressure equalization at atmospheric pressure, this is a significant increase in the feed pressure. The consequence is that practically all that is tapped is foam.

It is the task of the invention to create a foam throttle with which a tap of the type stated initially can be retrofitted in simple manner, with easy installation, and can be adapted, if necessary, to a tap with $CO_2$ under excess pressure, so that beer and foam are dispensed in an appropriate ratio.

The foam throttle that accomplishes this task consists of a hood that can be set onto the sleeve of the tap in front of the passage opening, which covers the passage opening, which encloses a labyrinth channel, together with the sleeve, which channel is open at one end, towards the interior of the container, and ends in the passage opening at the other end.

In a preferred embodiment, the labyrinth channel has a meander-shaped progression.

In a preferred embodiment, the open end of the labyrinth channel is located close to the outer end of the sleeve. This is of significance for complete emptying of the container. The tap is disposed closely above the base of the container, which is tilted to remove the remainder of the liquid. In this connection, a liquid level must be present at the open end of the labyrinth channel.

The labyrinth channel can be configured both on the outer mantle of the sleeve and on the inner mantle of the hood. In the case of the latter embodiment, the labyrinth channel can end in a tapping bore through the hood, or run out on a face of the hood. In this variant, the opening of the labyrinth channel is located even closer to the end of the sleeve.

In a preferred embodiment, the hood can be clipped onto the sleeve. The hood can be both fully cylindrical and partially cylindrical. In the latter variant, the hood has a looping angle of more than 180°, preferably approximately 220°. In this way, it holds tight to the sleeve by means of inherent elasticity, with slight spreading.

In a preferred embodiment, the sleeve is provided with ribs on its outer mantle. The hood of the foam throttle has recesses that fit over these ribs, for the purpose of positioning.

The invention will be explained in greater detail in the following, using two exemplary embodiments shown in the drawing. This shows:

Figure 5:
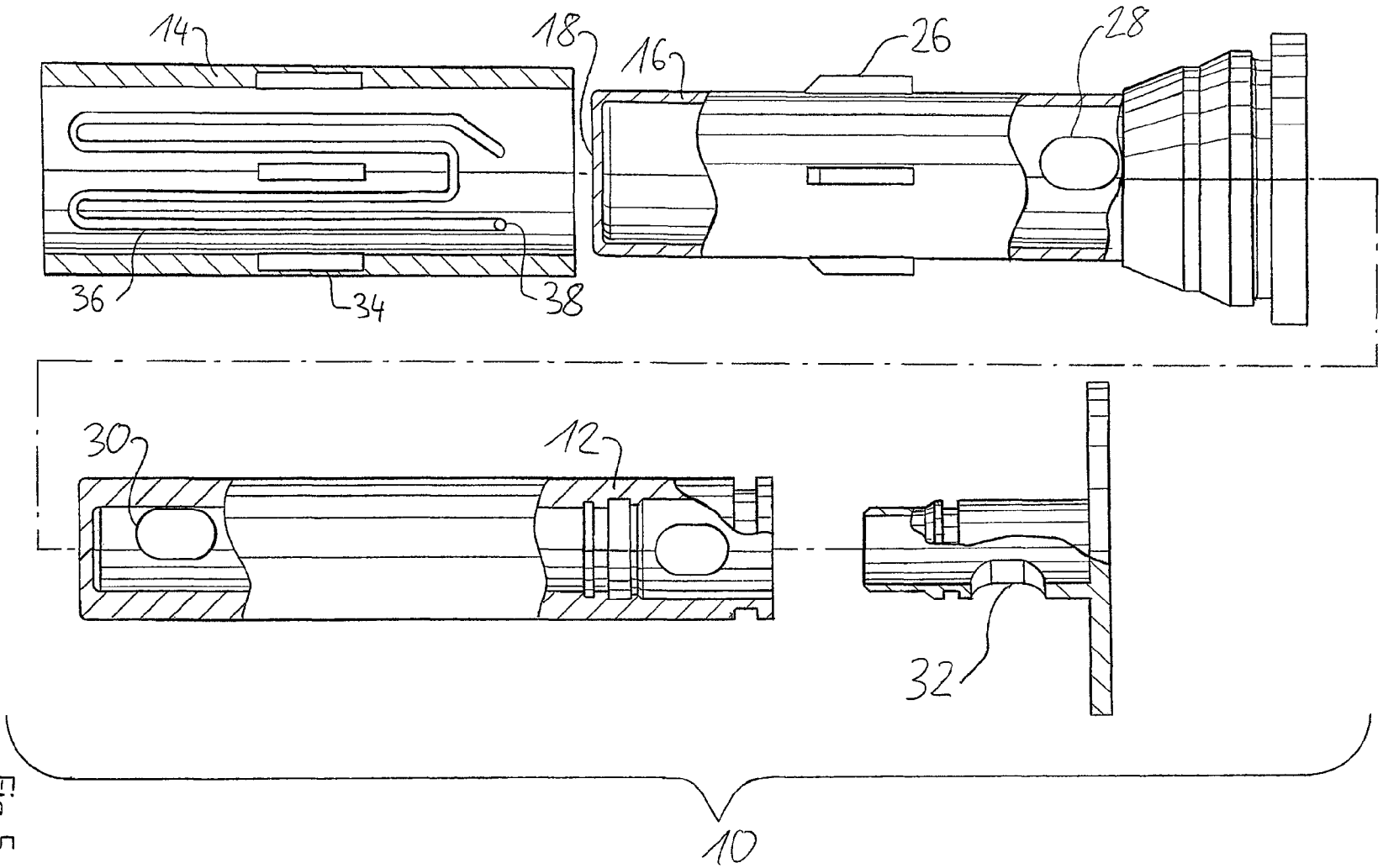
FIG. 5 is an exploded side sectional view of FIG. 1, in part elevation.

As seen in FIG. 5, the tap consists of a sleeve 10, piston 12, and a foam throttle 14.

The tap consists of a sleeve 10, a piston 12, and a foam throttle 14.

The sleeve 10 has a circular cylindrical beaker body 16, the base 18 of which is closed off at its inner end. At the outer end of the sleeve 10, a bung of elastic material is molded on, which widens conically, and has a flange-like outer contact part 20, a circumferential sealing part 22 that is recessed behind the former, and a conical engagement part 24 that is located ahead of the sealing part 22, the diameter of which is greater than that of the sealing part 22.

The tap is pressed into the round opening of a container that contains liquid to be tapped, as a completely pre-assembled unit of sleeve 10, piston 12, and foam throttle 14. This involves a liquid that was filled into the container without pressure or under pressure, which can be carbonated. Specifically, this involves the tapping of beverages, particularly beer, from kegs, small kegs (party kegs), or cans. The tap is pressed into the opening of the container with the beaker body 16 and the conical engagement part 24 of the sleeve 10 going first. The circumferential sealing part 22 accommodates the edge of the opening, forming a seal, so that it comes to rest between the flange-like contact part 20 and the engagement part 24 of the sleeve 10, with which the latter engages at the edge of the opening.

To align the sleeve 10 with reference to the piston 12 during assembly of the tap, four ribs 26 uniformly offset over the circumference are molded onto the outer mantle of its beaker body 16, which ribs extend in the longitudinal direction of the sleeve 10.

Figure 1:
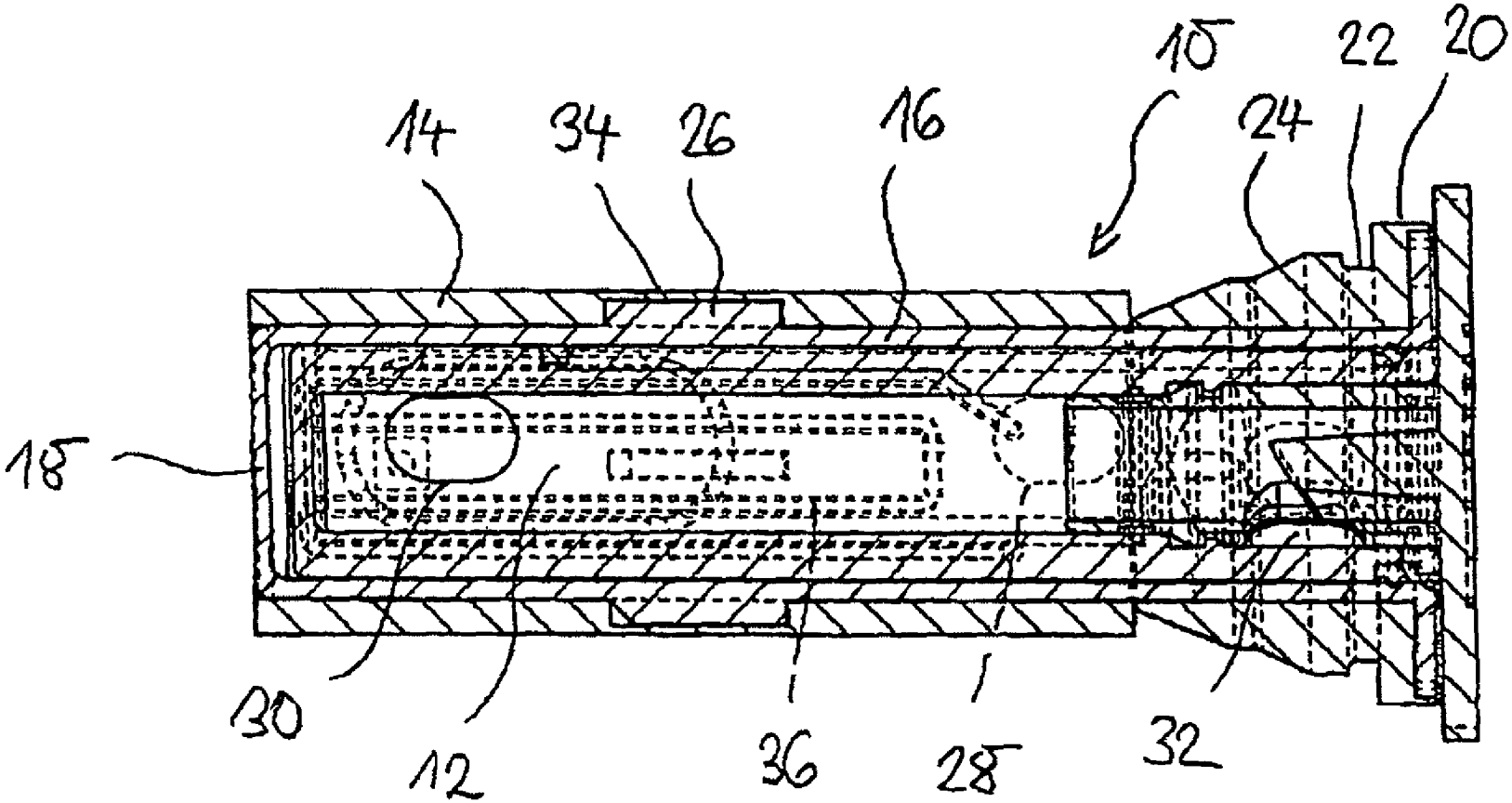
FIG. 1 is a side sectional view of a tap having a sleeve, a piston that is fitted into the sleeve, and a foam throttle clipped onto the sleeve.

The sleeve 10 has a passage opening 28 for the liquid to be tapped in the mantle wall of its beaker body. The piston is a cylindrical hollow body, the mantle wall of which has an entry opening 30 on the inner piston end, and an exit opening 32 for the liquid at its outer piston end. Before the keg is tapped for the first time, the piston 12 assumes a locking position in which it is moved into the sleeve 10 (see FIG. 1), in which it tightly closes off the passage opening 28 of the sleeve 10. By means of withdrawing the piston 12 from the sleeve 10, the entry opening 30 arrives at the level of the passage opening 28, and liquid flows through the interior of the piston to its exit opening 32.

The foam throttle 14 is a partially cylindrical hood made of plastic. The hood is clipped onto the outside of the beaker body 16 of the sleeve 10 in front of the passage opening 28, so that it covers the passage opening 28. The hood has a looping angle of approximately 220°. It sits tightly on the beaker body 16 of the sleeve 10 by means of its inherent elasticity, being slightly spread open.

The hood of the foam throttle 14 has recesses 34 in which three of the four ribs 26 on the outer mantle of the beaker body 16 fit. The foam throttle 14 is positioned by means of the engagement of the ribs 26 in the recesses 34.

Figure 2:
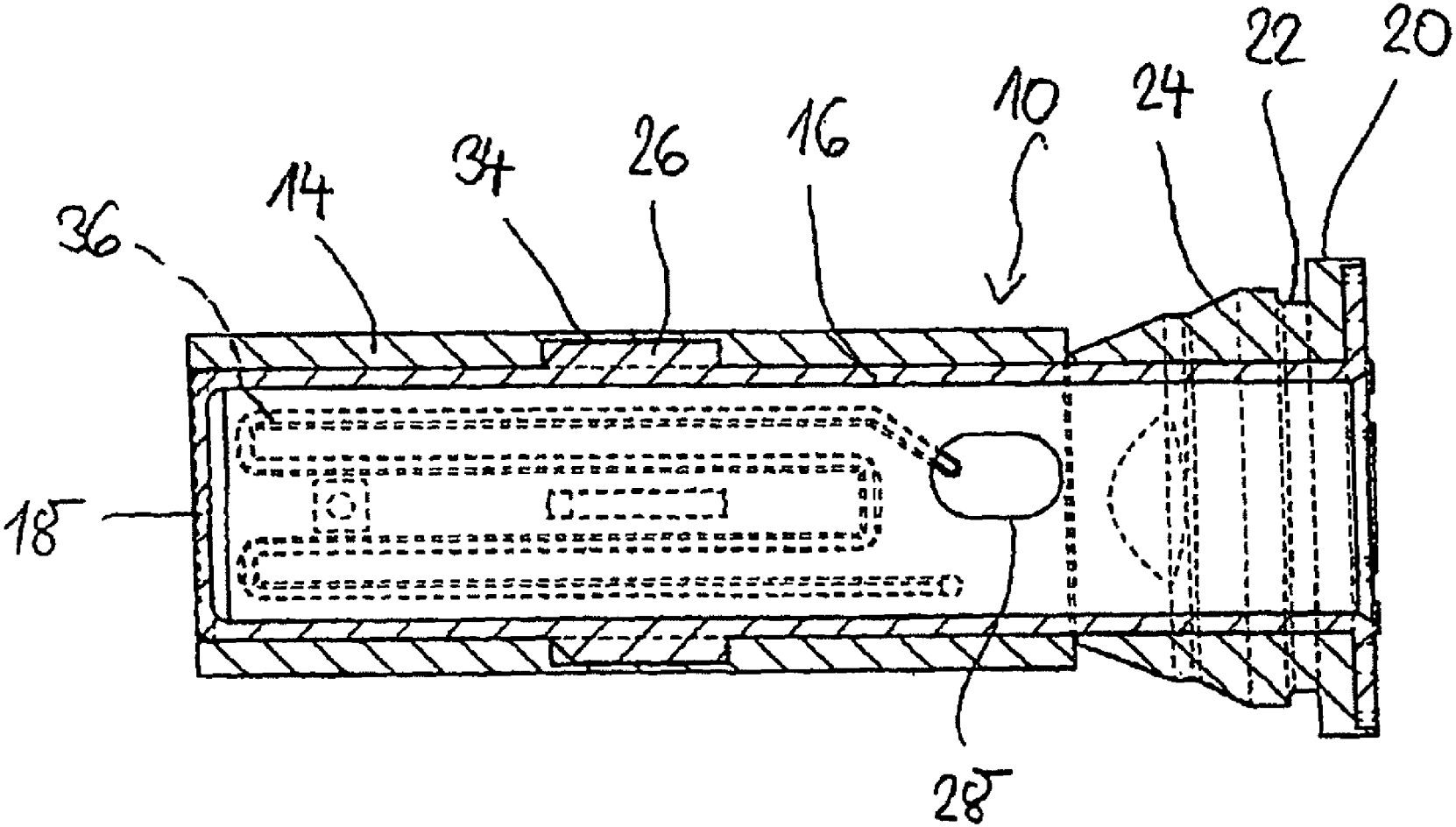
FIG. 2 is a side sectional view of the sleeve with the foam throttle.
Figure 3:
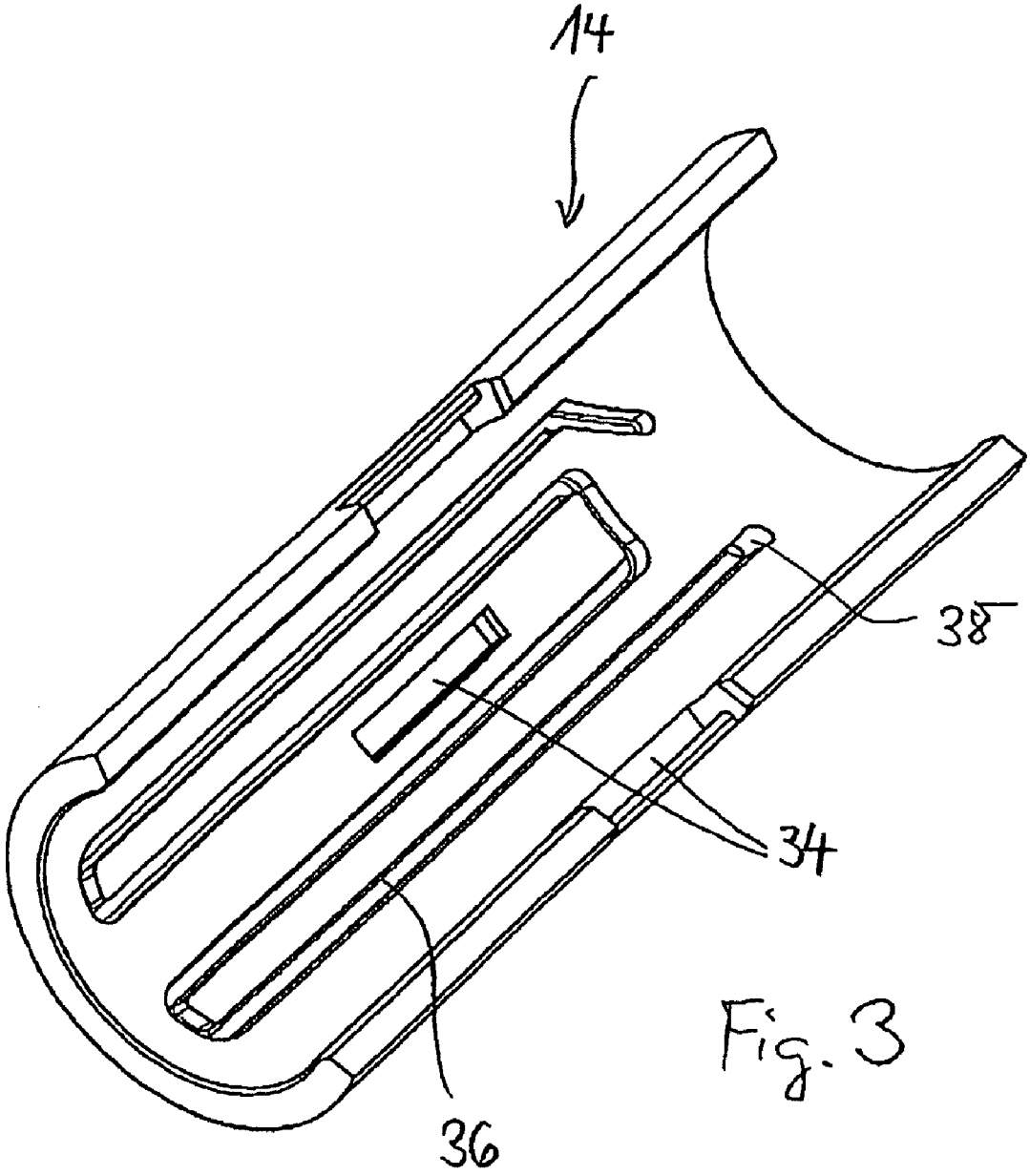
FIG. 3 is a perspective view of the foam throttle, looking towards the inside.
Figure 4:
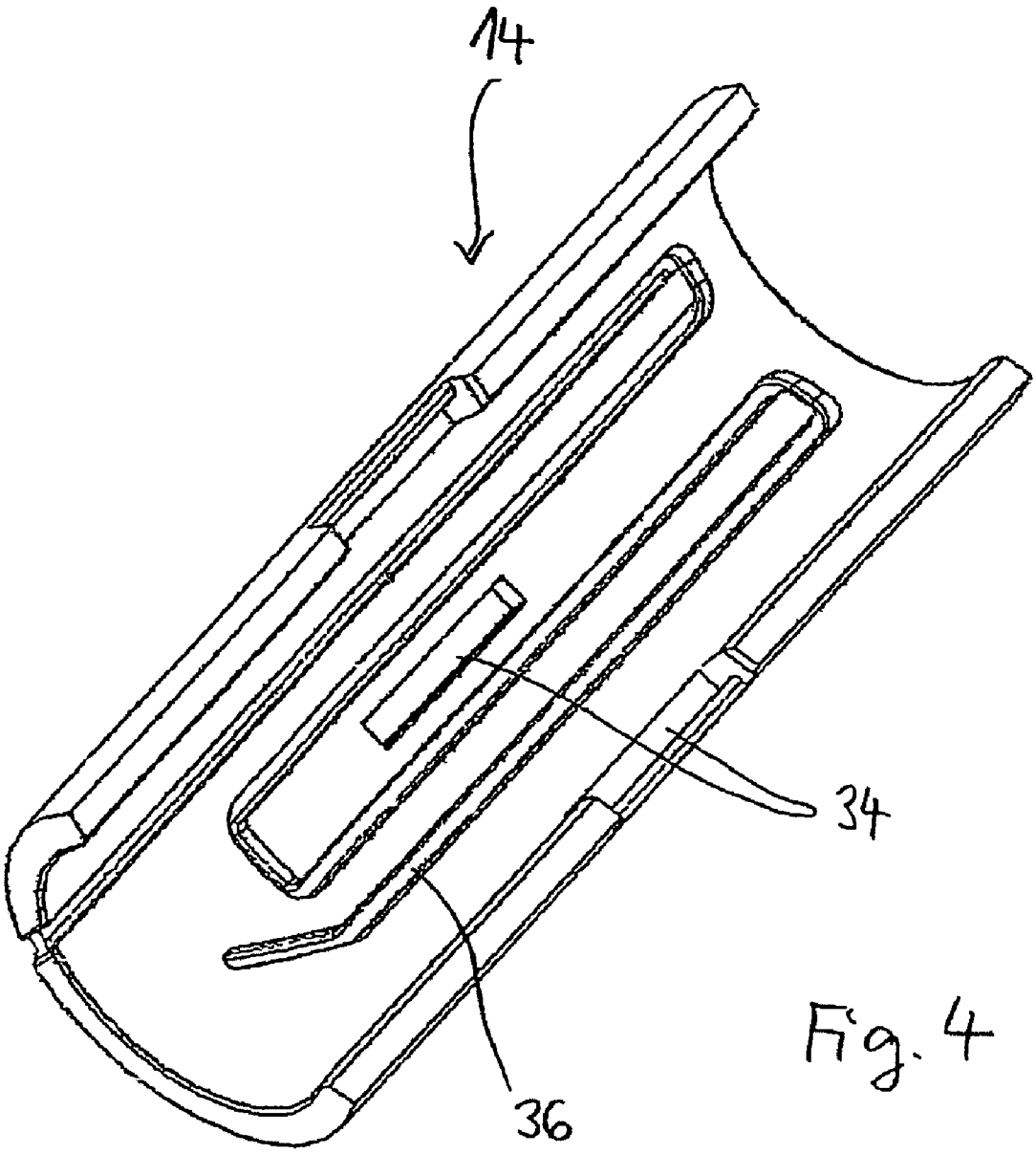
FIG. 4 is a perspective view of a modified foam throttle.

The hood of the foam throttle 14 has a labyrinth channel 36 having a meander-shaped progression, on the inside. The labyrinth channel 36 ends in the passage opening 28 of the sleeve 10 on the one end. In the variant according to FIG. 1 to FIG. 3, the other end of the labyrinth channel 36 leads into a tapping bore or tapping channel 38 that passes crosswise through the hood. The tapping bore 38 is located at the outer end of the sleeve 10, not far from the passage opening 28. In the variant according to FIG. 4, the labyrinth channel runs out on the face of the hood.

The invention claimed is:

1. A foam throttle for a tap for removing liquid from a container comprising:

a sleeve made of plastic which has a passage opening for the liquid to be removed from the container;

a piston guided in said sleeve and which is movable between a locking position, in which it is moved in to tightly seal off said passage opening and a removing position in which it is moved out to permit release of the liquid; and a hood disposed on said sleeve in front of said passage opening so that it covers said passage opening, wherein said hood together with said sleeve define and enclose a labyrinth channel having two ends, one of which is an open end which opens towards the interior of the container and other of which ends in said passage opening and wherein said hood is partially cylindrical and spans a circular arc of more than 180°.

2. The foam throttle according to claim 1, wherein:

said labyrinth channel has a meander-shaped progression.

3. The foam throttle according to claim 1, wherein:

said sleeve has an outer end and an inner end and said open end of said labyrinth channel is located close to said outer end of said sleeve.

4. The foam throttle according to claim 1, wherein:

said sleeve has an inner mantle and an outer mantle and said labyrinth channel is configured on said outer mantle of said sleeve.

5. The foam throttle according to claim 1, wherein:

said hood has an inner mantle and an outer mantle and said labyrinth channel is configured on said inner mantle of said hood.

6. The foam throttle according to claim 1, wherein:

said hood further comprises a tapping bore that passes through said hood and wherein said labyrinth channel ends in said tapping bore.

7. The foam throttle according to claim 1, wherein:

said hood has a face and said labyrinth channel runs out on said face of said hood.

8. The foam throttle according to claim 1, wherein:

said hood can be clipped onto said sleeve.

9. The foam throttle according to claim 1, wherein:

said sleeve is provided with ribs on its said outer mantle and said hood has recesses that fit over said ribs.

10. A foam throttle for a tap for removing liquid from a container comprising:

a sleeve made of plastic which has a passage opening for the liquid to be removed from the container and wherein said sleeve has an inner mantle and an outer mantle and is provided with ribs on its said outer mantle;

a piston guided in said sleeve and which is movable between a locking position, in which it is moved in to tightly seal off said passage opening and a removing position, in which it is moved out to permit release of the liquid; and a hood disposed on said sleeve in front of said passage opening so that it covers said passage opening, wherein said hood together with said sleeve define and enclose a labyrinth channel having two ends, one of which is an open end which opens towards the interior of the container and other of which ends in said passage opening and wherein said hood has recesses that fit over said ribs.

11. The foam throttle according to claim 10, wherein:

said labyrinth channel has a meander-shaped progression.

12. The foam throttle according to claim 10, wherein:

said sleeve has an outer end and an inner end and said open end of said labyrinth channel is located close to said outer end of said sleeve.

13. The foam throttle according to claim 10, wherein:

said labyrinth channel is configured on said outer mantle of said sleeve.

14. The foam throttle according to claim 10, wherein:

said hood has an inner mantle and an outer mantle and said labyrinth channel is configured on said inner mantle of said hood.

15. The foam throttle according to claim 10, wherein:

said hood further comprises a tapping bore that passes through said hood and wherein said labyrinth channel ends in said tapping bore.

16. The foam throttle according to claim 10, wherein:

said hood has a face and said labyrinth channel runs out on said face of said hood.

17. The foam throttle according to claim 10, wherein:

said hood can be clipped onto said sleeve.

18. The foam throttle according to claim 10, wherein:

said hood is fully cylindrical.

19. The foam throttle according to claim 10, wherein:

said hood is partially cylindrical and spans a circular arc of more than 180°.

* * * * *